US007111735B2

(12) United States Patent
Lowry

(10) Patent No.: US 7,111,735 B2
(45) Date of Patent: Sep. 26, 2006

(54) BASE FOR POST IN POST PRODUCT PACKAGING AND DISPLAY SYSTEM

(75) Inventor: James W. Lowry, Franklin, TN (US)

(73) Assignee: Sonoco Development, Inc., Hartsville, SC (US)

( * ) Notice: Subject to any disclaimer, the term of this patent is extended or adjusted under 35 U.S.C. 154(b) by 28 days.

(21) Appl. No.: 10/711,749

(22) Filed: Oct. 1, 2004

(65) Prior Publication Data

US 2006/0070911 A1 Apr. 6, 2006

(51) Int. Cl.
*B65D 81/02* (2006.01)
*B65D 5/00* (2006.01)

(52) U.S. Cl. ..... 206/586; 206/766; 206/736; 229/122.21; 229/122.32; 229/919

(58) Field of Classification Search ..... 206/320, 206/384, 736, 591–593, 430, 443, 586, 509–511, 206/499, 766; 229/122.21, 919; 211/126.1; 108/53.5
See application file for complete search history.

(56) References Cited

U.S. PATENT DOCUMENTS 1,991,616 A * 2/1935 Kondolf ..... 206/586
2,277,674 A * 3/1942 Belsinger ..... 229/122.33
3,073,500 A * 1/1963 Goodrich et al. ..... 206/447
3,397,831 A * 8/1968 Adams ..... 229/122.32
3,831,836 A * 8/1974 Ellison et al. ..... 229/199
4,341,338 A * 7/1982 Arnold ..... 229/122.21
4,638,745 A * 1/1987 Sheffer ..... 108/192
5,125,520 A * 6/1992 Kawasaki ..... 211/133.1
5,251,753 A * 10/1993 Pigott et al. ..... 206/766
5,865,316 A 2/1999 Smith
6,357,587 B1 3/2002 Melms, Jr.

FOREIGN PATENT DOCUMENTS

JP 10057204 3/1998
JP 10167253 6/1998

* cited by examiner

*Primary Examiner*—Jila M. Mohandesi
(74) *Attorney, Agent, or Firm*—Clausen Miller, P.C.

(57) ABSTRACT

A box-like base assembly for holding vertical support posts in an upright position. The base assembly includes an outer base box and a center base member that fits within the outer base box, the center base member having inwardly collapsed sections for holding the vertical support posts in an upright position.

4 Claims, 10 Drawing Sheets

BASE FOR POST IN POST PRODUCT PACKAGING AND DISPLAY SYSTEM

BACKGROUND

This patent relates to a post-in post product packaging and display system. More particularly, this patent relates to a base for a post-in-post packaging and display system that replaces a standard pallet.

Retailers such as mass merchandisers often display their products on the same pallets the products were shipped on from the vendors. The product containers sometimes are located on vertically spaced trays mounted over the pallet.

Sonoco Development, Inc., the assignee of the present invention, has developed a proprietary post-in-post system for the packaging, shipping and displaying of palletized products in a mass merchandising or general retail environment. The system, described in co-pending U.S. patent application Ser. No. 10/605,814, comprises a plurality of vertically spaced corrugated trays for holding the products, tubular outer support posts that support the trays and space them apart, and inner guide posts that key inside the support posts (thus "post-in-post") to lock the system together and provide axial compression strength. The entire assembly may be carried on a standard pallet and wrapped in an outer wrap to protect the products from dust and damage during shipment.

Each corrugated tray has die-cut openings large enough to accommodate the inner guide posts but smaller than the outer support posts. The outer support posts may be pre-attached to the trays over each opening. The outer support posts evenly space apart the trays and provide a platform for the tray above. The outer support posts also help hold and position the inner guide posts while the system is being assembled and during use.

The wood pallets commonly used to support the post-in-post system can be costly. It is therefore an object of the present invention to provide a base for a post-in-post packaging and display system that replaces conventional wood pallets.

Another object of the invention is to raise the products farther off the floor than a conventional wood pallet for better access by the shopper.

Still another object of the invention is to provide a base that offers more surface area for point-of-purchase advertising or other graphics.

Yet another object of the invention is to provide a base that makes assembly of a post-in-post packaging and display system easier by providing a means for holding the starter outer guide posts in place during assembly.

Further and additional objects will appear from the description, accompanying drawings, and appended claims.

SUMMARY OF THE INVENTION

The present invention is a base assembly for a post-in-post system for packaging, shipping and displaying product containers. The post-in-post system comprises a plurality of vertically spaced trays for holding the product containers, tubular outer support posts affixed over openings 24 in each tray such that the hollow interiors communicate with the openings, and inner guide posts inserted inside the outer support posts and through the tray openings to lock the trays together. The outer support posts provide a platform for each tray and space the trays apart.

The base assembly comprises an outer base box and a center base member that fits within the outer base box. The outer base box gives the base assembly its form and provides a large surface area for graphics, while the center base member helps hold a first set of outer support posts in an upright position and keeps the system stable during assembly. The entire system can be hand trucked and moved around by sliding forks or a lift blade under the outer base box, lifting the system and tilting it back.

The center base member comprises two opposing vertical sidewalls and two opposing vertical end walls joined together to define vertical corners. The holding means comprises at least one and preferably two inwardly collapsed sections formed from contiguous portions of a sidewall and an end wall. The inwardly collapsed sections define an interior cylindrical space for accommodating and holding an upright outer support post. Preferably the cylindrical space has a rectangular cross-section.

In addition to providing a means for holding the starter outer guide posts in place during assembly, the base assembly replaces a conventional wood pallet, raises the product containers farther off the floor than a conventional wood pallet, and provides a large surface area for graphics.

THE DRAWINGS

DETAILED DESCRIPTION OF THE INVENTION

The present invention is based on the post-in-post packaging, shipping and display system described in pending U.S. patent application Ser. No. 10/605,814 incorporated herein by reference. A principal feature of the present invention is a two-piece, box-like base assembly that replaces a conventional wood pallet, provides a large surface area for graphics, makes assembly easier by holding the starting outer support posts in place, and elevates the products from the floor for better customer access.

Figure 1:
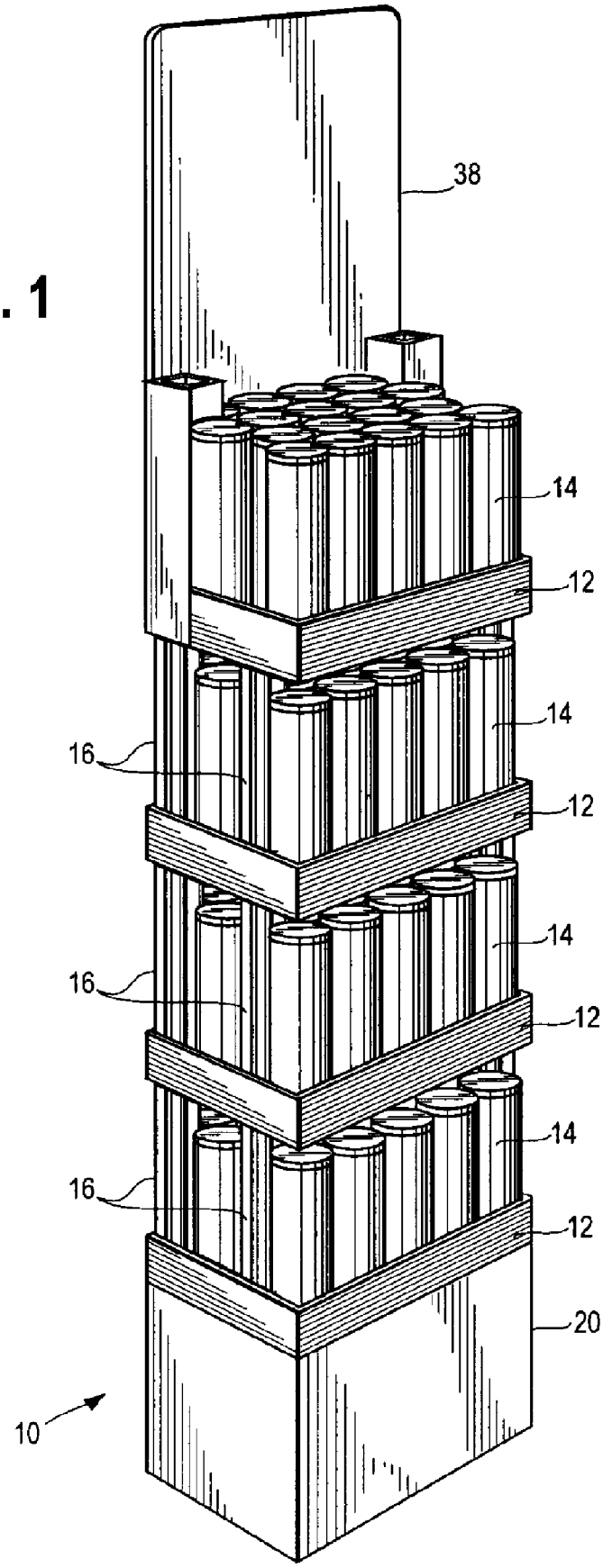
FIG. 1 is a perspective view of a first embodiment of a post-in-post product packaging and display system according to the present invention, shown in display mode.
Figure 2:
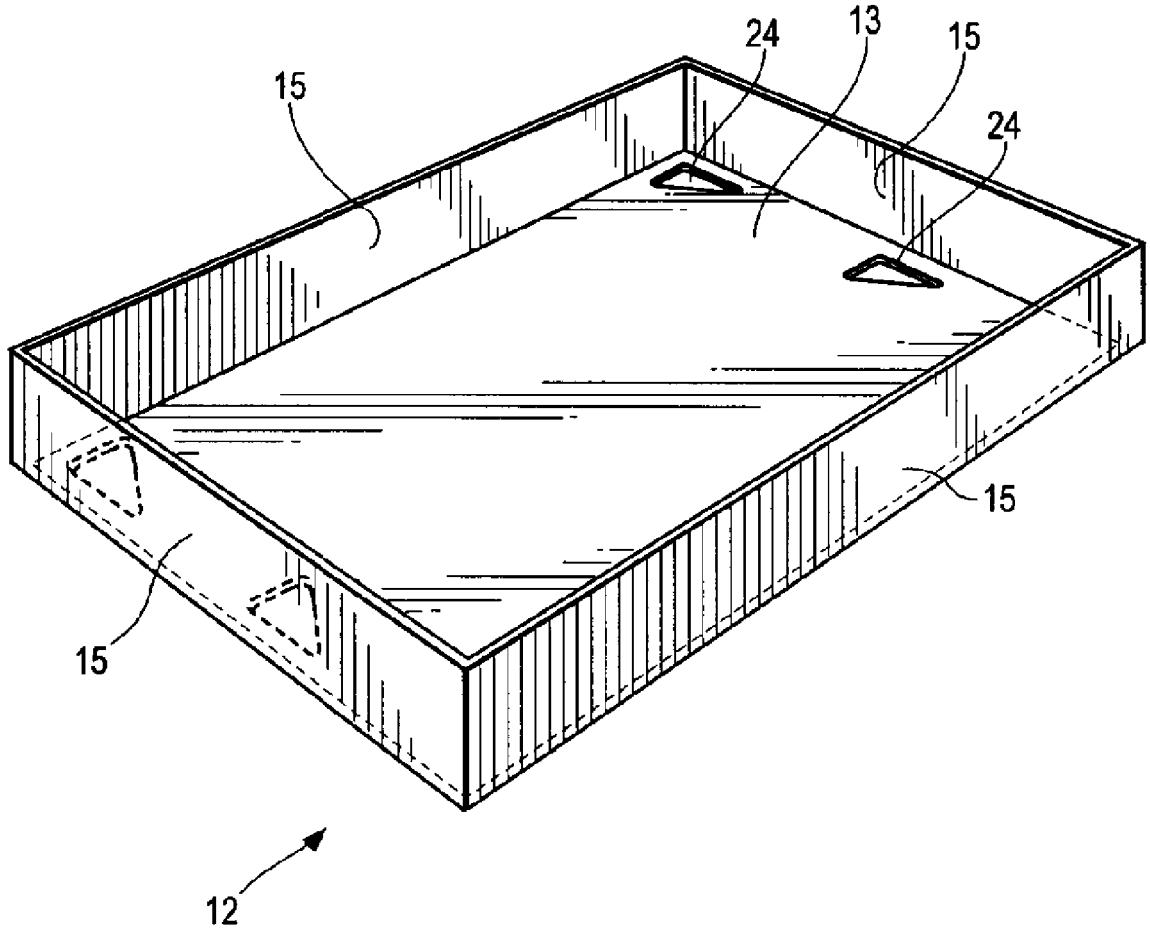
FIG. 2 is a perspective view of a tray used in the packaging and display system of FIG. 1.
Figure 3:
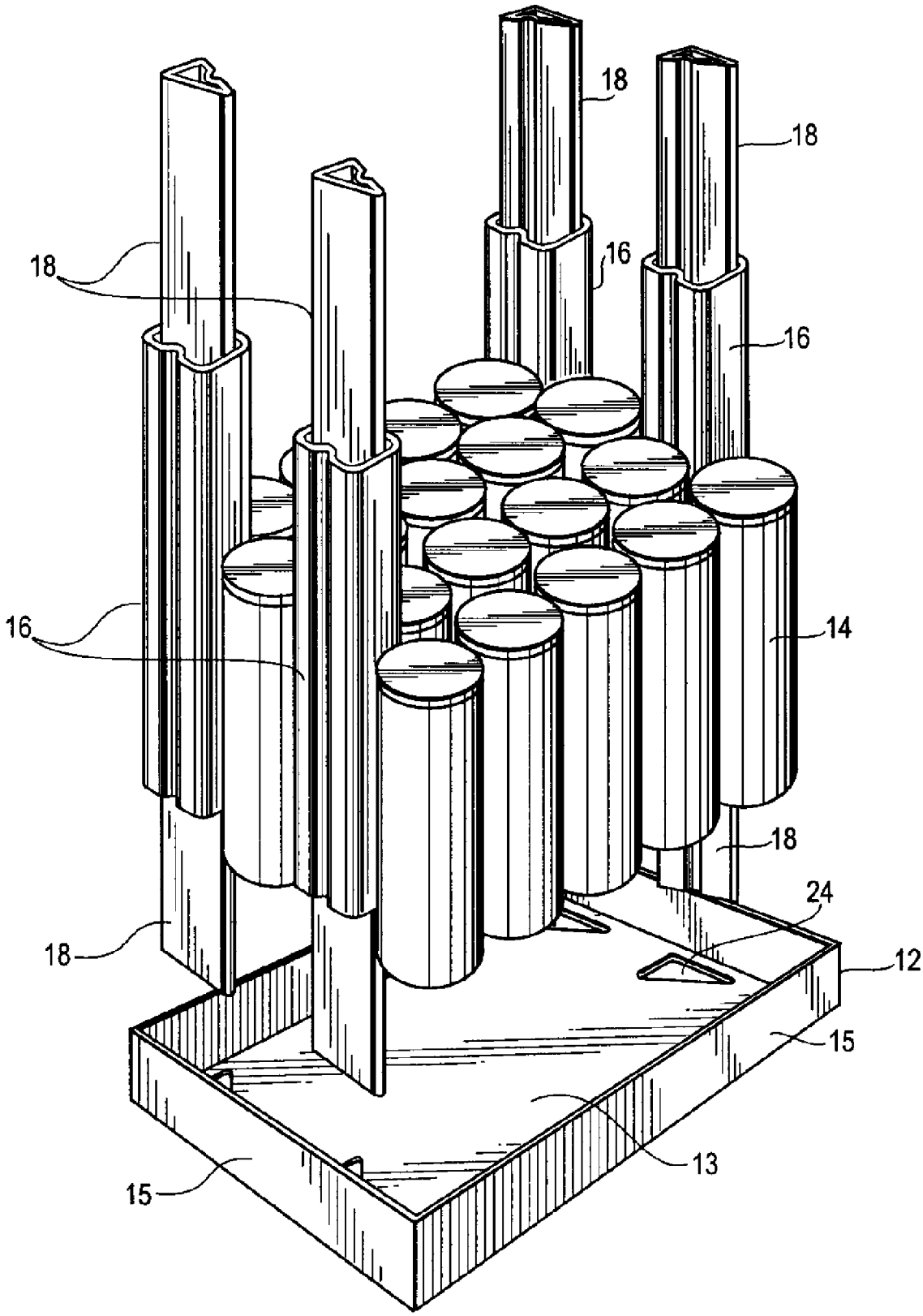
FIG. 3 is a perspective view of a one layer of the packaging and display system of FIG. 1.
Figure 4:
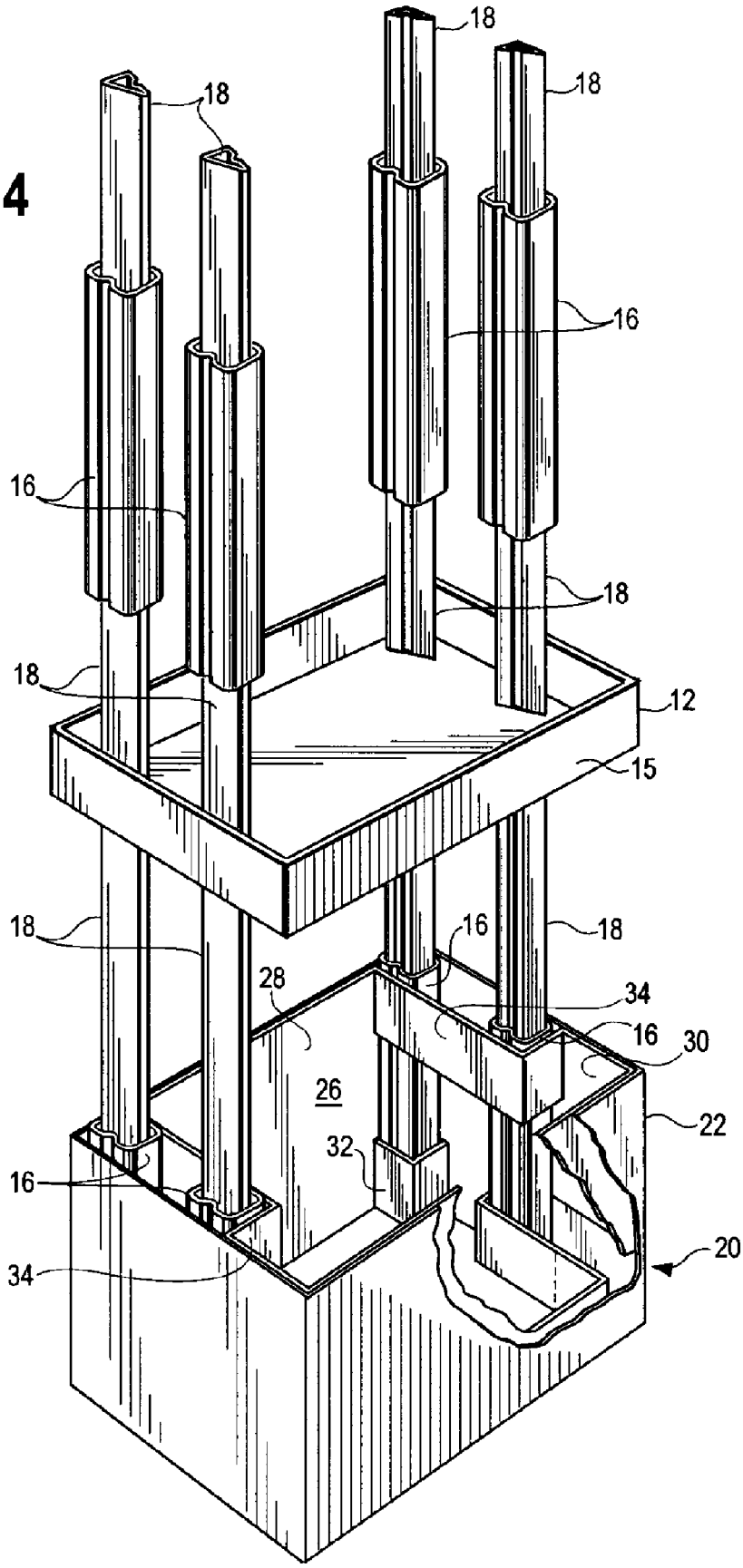
FIG. 4 is an exploded perspective view of the bottom part of the packaging and display system of FIG. 1.

FIGS. 1–8 depict a first embodiment of a post-in-post packaging and display system according to the present invention. The packaging and display system 10 comprises vertically spaced product trays 12 for holding the product containers 14 (in the illustrated embodiment, cylindrical snack food containers), hollow outer support posts 16 affixed over openings 24 die-cut into in each product tray 12 (FIG. 2), and, as best shown in FIGS. 3–4, inner guide posts 18 keyed (inserted) inside the outer support posts 16 and through the tray openings 24 to lock the trays 12 together. The outer support posts 16 provide a platform for each tray 12 and evenly space the trays 12 apart.

Referring to FIG. 2, the product trays 12 preferably are formed from corrugated board, although any suitable material may be used. Each tray 12 comprises a bottom panel 13 and short side and end panels 15 extending upward from the periphery of the bottom panel 13. The bottom panel 13 and/or side and end panels 15 may be printed or otherwise decorated in any desirable fashion to increase the aesthetic appeal of the display.

The bottom panel 13 has die-cut openings 24 disposed in the void spaces around the product containers 14. These openings 24 are large enough to accommodate the inner guide posts 18 but smaller than the outer support posts 16 or configured such that the outer support posts 16 cannot fit within the openings 24. The number of openings 24 in each tray 12 is a function of the number of outer support posts 16 used on each layer. A typical system 10 as shown in the figures will have four outer support posts 16 per layer and thus at least four openings 24 in each tray 12.

Additional means for helping to keep the product containers 14 in place may be employed. For example, optional dividers (not shown) may be placed around the individual product containers 14 on each tray 12, although these dividers need not be load bearing. Inserts with die cut openings for receiving the bottoms of the product containers 14 may be placed within the trays 12. Sticky clean peel adhesive sheets may be placed on the trays 12 under the product containers 14 to help keep the product containers 14 secure.

The outer support posts 16 space the trays 12 apart and provide a platform for the trays 12. The height of the outer support posts 16 is determined by the height of the product containers 14 or, more particularly, the desired height between trays 12. The outer support posts 16 are located over each tray opening 24 so that their hollow interiors communicate with the openings 24, and may be pre-attached to the trays 12 in some fashion, such as by adhesive, tape or staples.

Preferably, the outer support posts 16 are hollow paper tubes formed into a desired shape, such as those marketed by Sonoco Products Company of Hartsville, S.C. and described in U.S. Pat. Nos. 4,482,054; 5,593,039; 6,059,104 and 6,186,329, incorporated herein by reference. In the embodiment illustrated in the figures, the outer support posts 16 have a substantially rectangular cross-sectional profile with beads or grooves running longitudinally along two opposing sides, although any suitable cross-sectional shape may be used, including circular and triangular. Since the outer support posts 16 are visible to the consumer, they too may be printed or otherwise decorated in any desirable fashion to increase the aesthetic appeal of the display.

The inner guide posts 18 must be small enough to slide inside the outer support posts 16 and through the openings 24 in the trays 12. Like the outer support posts 16, the inner guide posts 18 may be wound paper tubes such as those manufactured by Sonoco Products Company. The inner guide posts 18 may have any suitable cross-sectional shape, including but not limited to triangular, and should fit snugly inside the outer support posts 16.

The length of the inner guide posts 18 is a function of the height of the system 10 and the outer support posts 16. A single set of four inner guide posts 18 may extend the entire height of the system from the bottom of the base assembly 20 to at least partway through the uppermost outer support post 16 to lock the trays 12 together. Alternatively, two or more sets of inner guide posts 18 may be arranged (stacked) vertically inside the outer support posts 16.

Unlike the post-in-post system described in U.S. patent application Ser. No. 10/605,814, the bottom tray 12 does not rest on a standard wood pallet. Instead, as best shown in FIG. 4, the bottom tray 12 rests on a two-piece box-like base assembly 20. The base assembly 20 raises the product containers 14 above the floor for better access by the consumer, provides a larger surface area for point of sale advertising, and makes construction of the system easier by holding the starting support posts 16 steady during assembly.

The two-piece base assembly 20 comprises an outer base box 22 and a center base member 26 that fits within the outer base box 22. The outer base box 22 is a conventional folded box having a bottom, sides extending upward from the periphery of the bottom and an open top. The bottom may be closed with glue, staples, tape or other means. The sides of the outer base box 22 may be used to display graphics such as point-of-sale advertising. The height of the base assembly 20 should be substantially the same as the length of the outer support posts 16.

The center base member 26 is of folded corrugated construction, open at the top and bottom and comprising two opposing vertical sidewalls 28 connected at their corresponding ends by two opposing vertical end walls 30. (For the purpose of this description and with reference to the figures the center base member "sidewalls" are the two opposing panels having the longer dimension and the "end walls" are the two opposing panels having the shorter dimension.) The junctions of the sidewalls 28 and end walls 30 define the four vertical corners of the center base member 26.

Still referring to FIG. 4, in this first embodiment, two starter (bottommost) outer support posts 16 are placed within the center base member 26 adjacent the rear corners and two outer support posts 16 are placed within the center base member 26 adjacent the end walls 35 intermediate the front and rear corners. Each outer support post 16 adjacent a rear corner is held in place near its lower end by an inwardly collapsed section 32 and near its upper end by an elongated inwardly collapsed section 34. Each outer support post 16 located intermediate the front and rear corners of the center base member 26 is held in place near its upper end by the elongated inwardly collapsed section 34 and near its lower end by an elongated inwardly collapsed section 34 (hidden in FIG. 4). The construction of the center base member 26 and the formation of the inwardly collapsed sections 32, 34 will be described in more detail below with respect to a second embodiment of the invention.

The inwardly collapsed sections 32, 34, together with the sidewalls 28 and end walls 30 define cylindrical spaces within which the starter outer support posts 16 are inserted. The starter outer support posts 16 are held snugly in place by the inwardly collapsed sections 32, 34, making assembly of the rest of the post-in-post easier.

Any number of trays 12 can be spaced vertically above the base assembly 20. By way of example only, and without limitation as to the scope of the invention, to assemble the four tray (four layer) packaging and display system 10 of FIGS. 1, 7 and 8, the vendor inserts a center base member 26 inside an outer base box 22 to form the base assembly 20. Then a first set of four outer support posts 16 is placed upright within the inwardly collapsed sections 32, 34 of the center base member 26. The base assembly 20 helps hold these "starter" outer support posts 16 steady, making the rest of the assembly easier. Next, a first set of four inner guide posts 18 is inserted inside the first set of outer support posts 16. This first set of inner guide posts 18 should extend above the first set of outer support posts 18.

The vendor then places a first tray 12 over the inner guide posts 16 and slides it down until it rests on the first set of outer support posts 16. The vendor then slides a second set of outer support posts 16 over the inner guide posts 18 as shown in FIG. 4. The vendor proceeds in this fashion until a four tray system 10 is assembled and ready for shipping.

Figure 7:
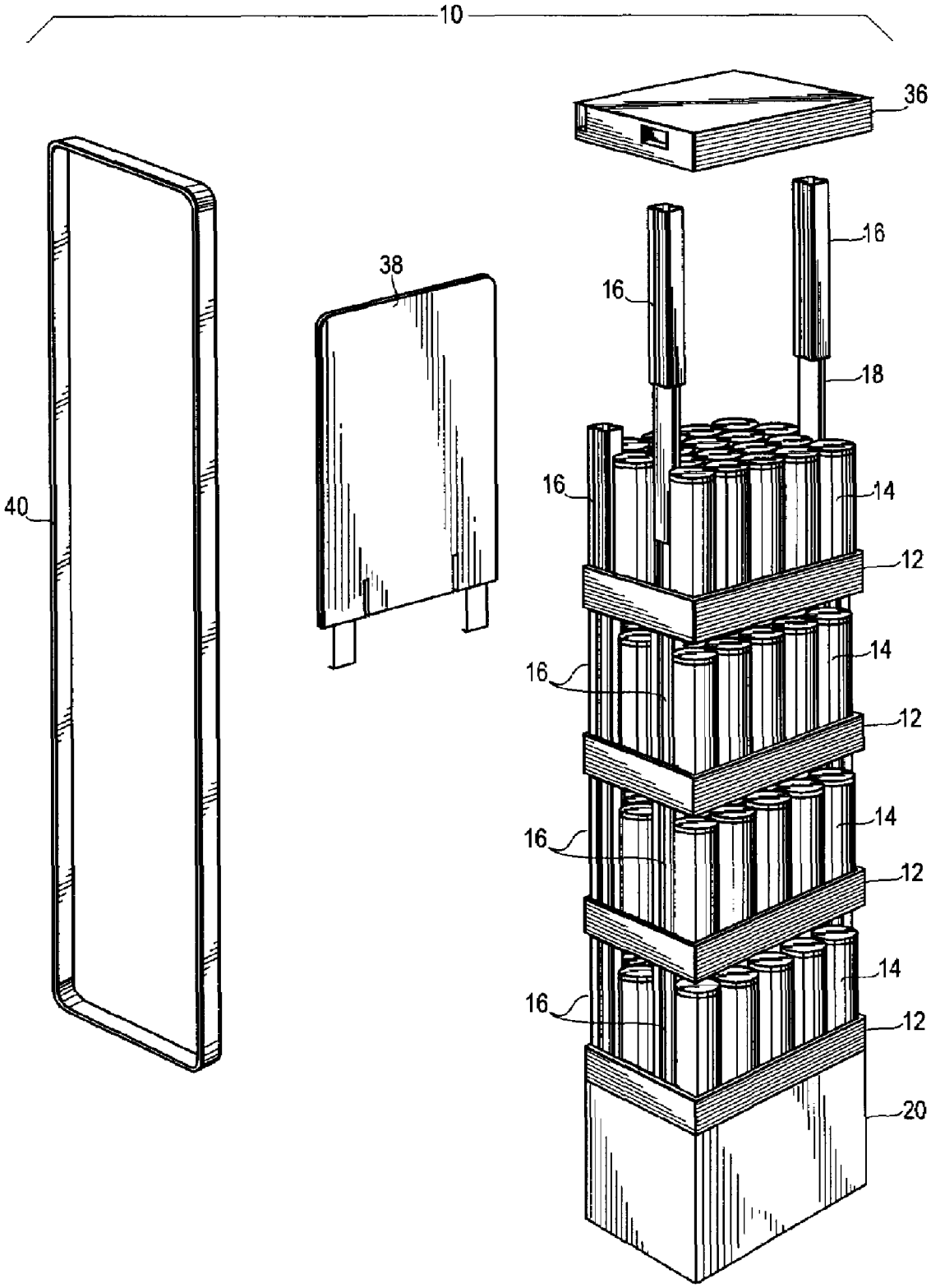
FIG. 7 is an exploded perspective view of the packaging and display system of FIG. 1 shown in shipping mode.
Figure 8:
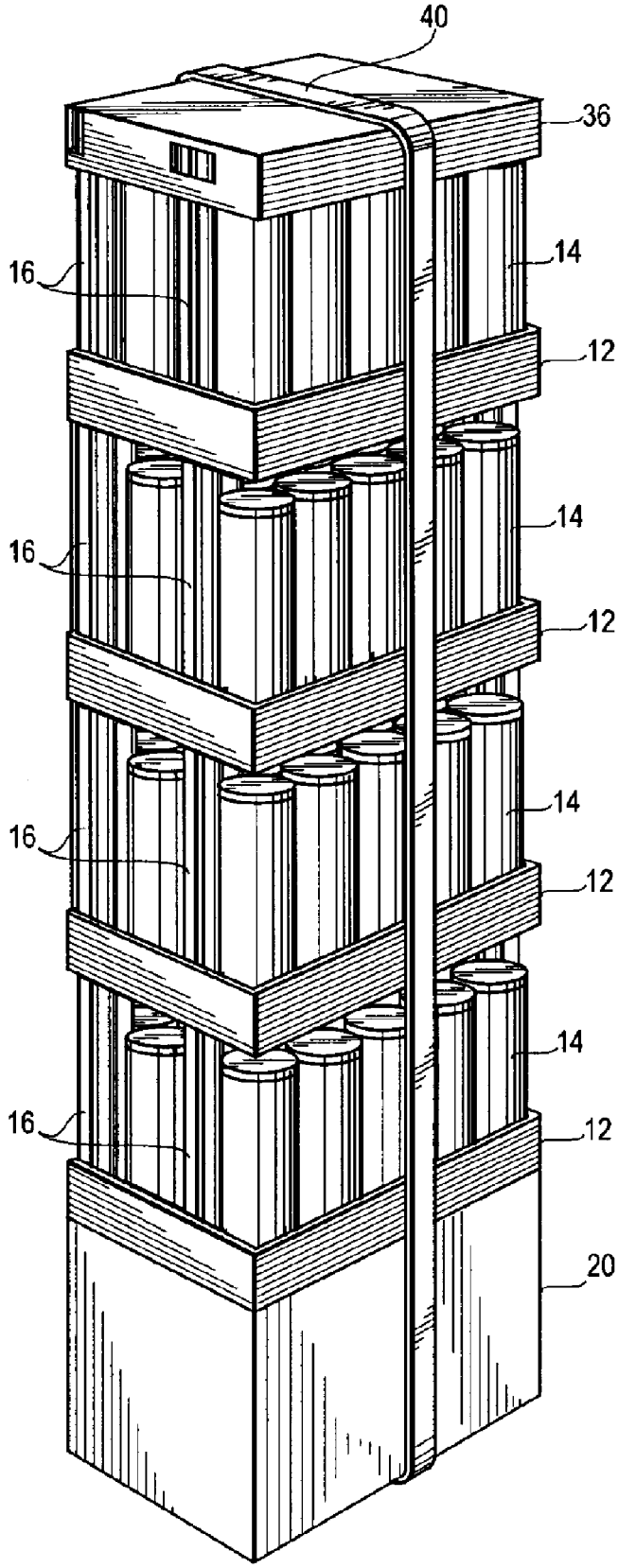
FIG. 8 is a perspective view of the packaging and display system of FIG. 1 shown in shipping mode.

FIG. 7 is an exploded perspective view of the entire packaging and display system 10 in shipping mode, including the top cap 36, display header board 38 and shipping strap 40. FIG. 8 is a view of the packaging and display system of FIG. 7 shown assembled and ready to ship.

Figure 5:
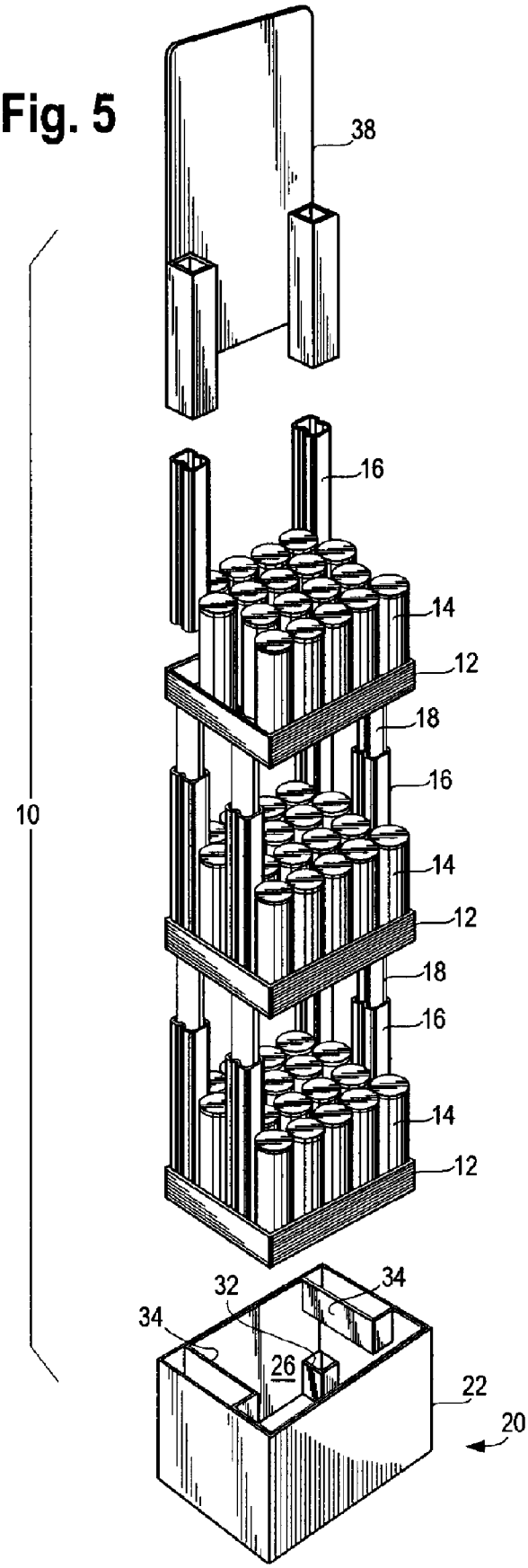
FIG. 5 is an exploded perspective view of a packaging and display system similar to that of FIG. 1 but having three layers instead of four.
Figure 6:
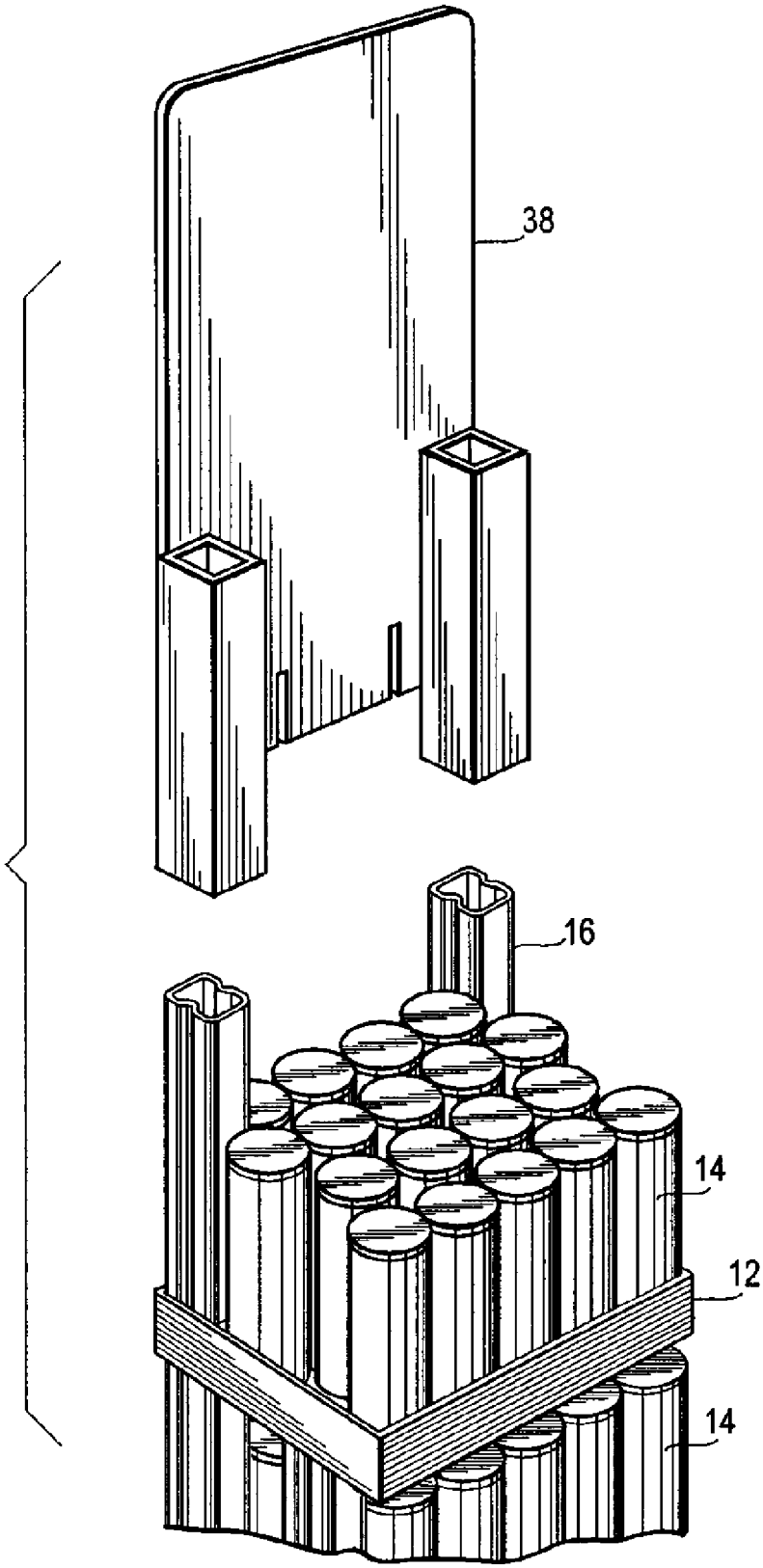
FIG. 6 is an exploded perspective view of the top part of the packaging and display system of FIG. 1.

After the packaging and display system 10 is shipped to its destination, the strap 40 (and optional outer wrap) may be removed and the header board 38 attached to the uppermost support posts 16, as shown in FIGS. 5 and 6. Attaching the header board 38 to the rear of the system 10 helps prevent the system 10 from tilting forward when product containers 14 remain only in the front part of the trays 12 forward the outer support posts 16.

FIGS. 9–12 depict a second embodiment of the packaging and display system 100 of the present invention, one in which the posts are located at the four corners of the system. As in the first embodiment, the system 100 comprises vertically spaced product trays 112 for holding the product containers 114, hollow outer support posts 116 affixed over openings 124 die-cut into in each tray 112, and inner guide posts 118 keyed inside the outer support posts 116 and through the tray openings 124 to lock the trays 112 together.

Figure 9:
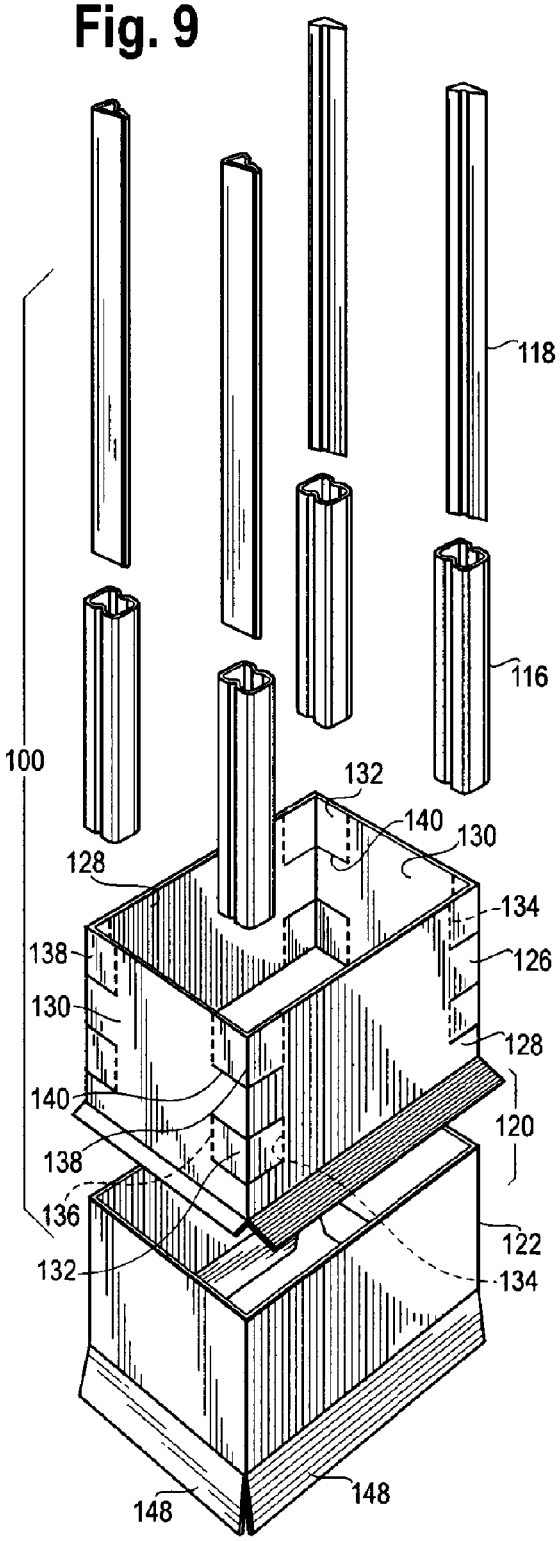
FIG. 9 is an exploded perspective view of the bottom part of a second embodiment of the product packaging and display system according to the present invention.
Figure 10:
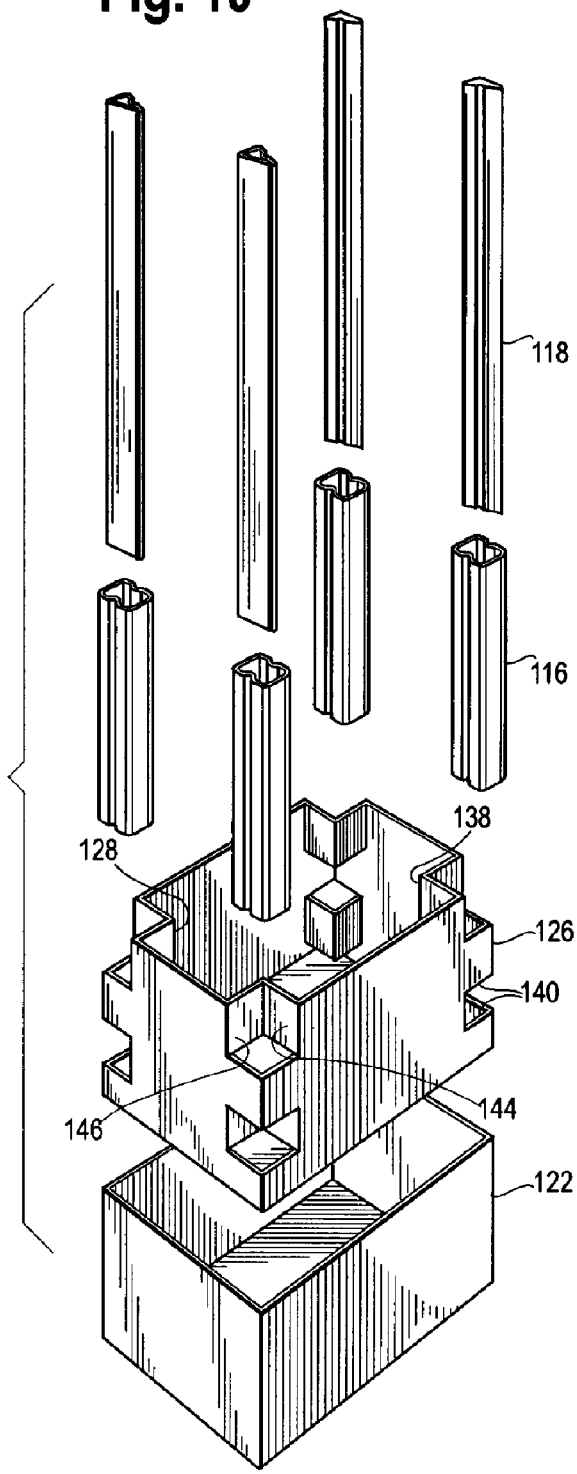
FIG. 10 is another exploded perspective view of the bottom part of a second embodiment of the product packaging and display system according to the present invention.
Figure 11:
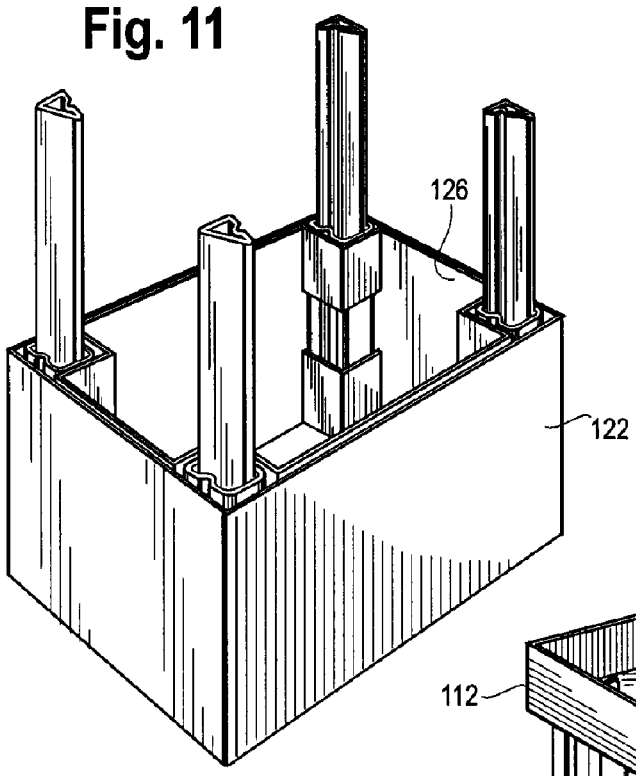
FIG. 11 is a perspective view of the assembled product packaging and display system of FIG. 10.

The bottommost tray 112 rest on a two-piece box-like base assembly. As best shown in FIGS. 9 and 10, the base assembly 120 comprises an outer base box 122 and a center base member 126 that fits within the outer base box 122. The outer base box 122 is a conventional folded box having a bottom, sides extending upward from the periphery of the bottom and an open top. The exposed sides of the outer base box 122 may be used to display graphics such as point-of-sale advertising.

The construction of the center base member 126 will now be described in detail. Referring to FIG. 9, the center base member 126 preferably is of folded corrugated construction, open at the top and bottom and comprising two opposing vertical sidewalls 128 connected at their corresponding ends by two opposing vertical end walls 130. The junctions of the sidewalls 128 and end walls 130 define the four vertical corners of the center base member 126. Inwardly collapsible sections 132 are die cut from the side walls 128 and end walls 130. Each inwardly collapsible section 132 is connected to a side wall by a first fold line 134 and to an end wall 130 by a second fold line 136. Each inwardly collapsible section 132 has an intermediate fold line 138 collinear with a corner that acts like a living hinge to enable the section 132 to collapse inwardly. Each inwardly collapsible section 132 is further defined by horizontal die cut lines 140 extending from the first fold line 134 on a side wall 128 to the second fold line 136 on an end wall 130.

At least one, and preferably two, inwardly collapsible sections 132 are located at each corner. An upper inwardly collapsible section 132 may be formed at each corner by cutting a horizontal line 140 through a portion of a sidewall 128 and a portion of an end wall 130 adjacent the corner and a short distance from the top edge 142 of the center base member 126. A lower inwardly collapsible section 132 may be formed at each corner by cutting a pair of horizontal lines 140 through a portion of a sidewall 128 and a portion of an end wall 130 adjacent a corner.

As best shown in FIG. 10, the collapsible sections 132 are displaced inwardly by applying sufficient pressure along the intermediate fold lines 138 to cause the sections 132 to collapse inwardly by virtue of bending along the first and second fold lines 134, 136. The intermediate fold lines 128 move into the inner space of the center base member 126 to form an internal corner. The portion 144 of the sidewall 128 between the first fold line 134 and the intermediate fold line 138 now extends perpendicularly to the rest of the sidewall 128. Likewise, the portion 146 of the end wall 130 between the second fold line 136 and the intermediate fold line 138 extends perpendicularly to the rest of the end wall 130.

The internal walls 144, 146, the sidewall 128 and the end wall 130 define the four sides of an interior cylindrical space open at the top for accommodating an upright outer support post 116. The interior cylindrical space preferably has a rectangular cross-section.

In the second embodiment shown in FIGS. 9–12, there are two inwardly collapsed sections 132 at each corner that, in conjunction with a sidewall 128 and an end wall 130, hold a starter outer support post 116 in place to facilitate assembly of the packaging and display system 10.

The center base member 126 also has flaps 148 extending from the bottom edges of the sidewalls 128 and end walls 130. The flaps 148 extend inwardly under the outer support posts 116 to help support the posts 116 when lifting up on the system 100 by hand truck or other means.

Figure 12:
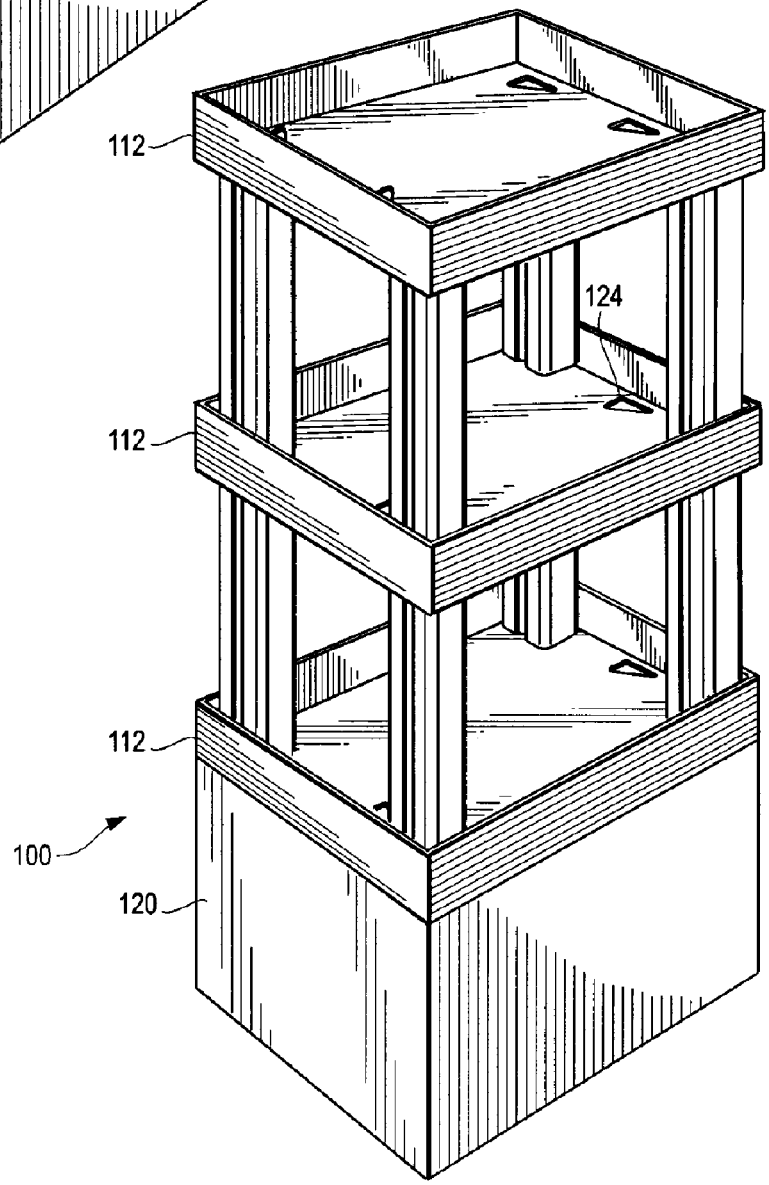
FIG. 12 is a perspective view of a second embodiment of the product packaging and display system according to the present invention.

As in the first embodiment, any number of trays 112 can be spaced vertically above the base assembly 120. FIG. 12 shows a three tray system 100 in display mode, without an optional header board. To assemble the three tray packaging and display system 100 of FIG. 12, the vendor inserts the center base member 126 inside the outer base box 122 to form the base assembly 120, then places four starter outer support posts 116 upright within the inwardly collapsed sections 132 of the center base member 126. The base assembly 120 helps hold these outer support posts 116 steady, making the rest of the assembly easier.

Thus there has been described a post-in-post system for packaging, shipping and displaying products. The system features a base assembly that replaces conventional wood pallets, raises the products farther off the floor than a conventional wood pallet, provides a large surface area graphics, and provides a means for holding starter outer support posts in place during assembly.

Other modifications and alternative embodiments of the invention are contemplated that do not depart from the scope of the invention as defined by the foregoing teachings and appended claims. It is intended that the claims cover all such modifications that fall within their scope.

What is claimed is:

1. In an improved system for packaging, shipping and displaying product containers, the system comprising a plurality of vertically spaced trays for holding the product containers; outer support posts having hollow interiors, the outer support posts located over openings in each tray such that their hollow interiors communicate with the openings;

and inner guide posts inserted inside the outer support posts and through the tray openings to lock the trays together, the improvement comprising:

a base assembly comprising an outer base box and a center base member that fits within the base box, the center base member having a top edge, two opposing vertical sidewalls and two opposing vertical end walls joined together to define vertical corners, and means for holding a first set of outer support posts in an upright position within the base assembly, said means comprising at least one inwardly collapsible section formed from contiguous portions of a sidewall and an end wall whose junction defines one of the vertical corners, the at least one inwardly collapsible section being defined by at least one horizontal cut line extending from a first fold line on a side wall to a second fold line on an end wall, said inwardly collapsible section also having a third fold line between the first and second fold lines serving as a living hinge to enable the inwardly collapsible section to collapse inwardly.

2. The system of claim 1 wherein the inwardly collapsible section defines an interior cylindrical space for accommodating an upright outer support post.

3. The system of claim 2 wherein the cylindrical space has a rectangular cross-section.

4. The system of claim 1 comprising at least one inwardly collapsible section at each corner.

* * * * *